US011365570B2

(12) United States Patent
Beck et al.

(10) Patent No.: US 11,365,570 B2
(45) Date of Patent: Jun. 21, 2022

(54) DOOR HANDLE ASSEMBLY FOR A MOTOR VEHICLE

(71) Applicant: Huf Huelsbeck & Fuerst GmbH & Co. KG, Velbert (DE)

(72) Inventors: Andreas Beck, Bochum (DE); Serdal Bitirim, Velbert (DE); Dirk Mueller, Essen (DE); Martin Witte, Ahaus (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 1194 days.

(21) Appl. No.: 15/744,624

(22) PCT Filed: Jul. 4, 2016

(86) PCT No.: PCT/EP2016/065642
§ 371 (c)(1),
(2) Date: Jan. 12, 2018

(87) PCT Pub. No.: WO2017/009077
PCT Pub. Date: Jan. 19, 2017

(65) Prior Publication Data

US 2018/0230717 A1 Aug. 16, 2018

(30) Foreign Application Priority Data

Jul. 13, 2015 (DE) ..... 102015111311.2
Oct. 29, 2015 (DE) ..... 102015118523.7
(Continued)

(51) Int. Cl.
*E05B 81/76* (2014.01)
*E05B 1/00* (2006.01)
*E05B 85/10* (2014.01)

(52) U.S. Cl.
CPC ..... *E05B 81/76* (2013.01); *E05B 1/0015* (2013.01); *E05B 81/77* (2013.01); *E05B 85/10* (2013.01)

(58) Field of Classification Search
CPC ..... E05B 81/76; E05B 81/77; E05B 85/10; E05B 1/0015
See application file for complete search history.

(56) References Cited

U.S. PATENT DOCUMENTS 10,385,595 B2 * 8/2019 Witte ..... E05B 81/77
10,661,754 B2 * 5/2020 Gerdes ..... B60R 25/245
(Continued)

FOREIGN PATENT DOCUMENTS

DE 1020141184 * 8/2015 ..... E05B 81/77
FR 2217784 A1 9/1974
(Continued)

OTHER PUBLICATIONS

European Patent Office as the International Searching Authority, International Search Report for PCT Application No. PCT/EP2016/065642, dated Sep. 22, 2016.
(Continued)

*Primary Examiner* — Kristina R Fulton
*Assistant Examiner* — Thomas L Neubauer
(74) *Attorney, Agent, or Firm* — Honigman LLP

(57) ABSTRACT

A vehicle door handle assembly with a sensor device for detecting an actuation is provided. A handle of the handle assembly has a section which can be gripped from behind and an outer wall that delimits an interior in which an electronic sensor device is arranged and fixed. The handle section is formed with a reduced outer wall thickness in an
(Continued)

Figure 1A:
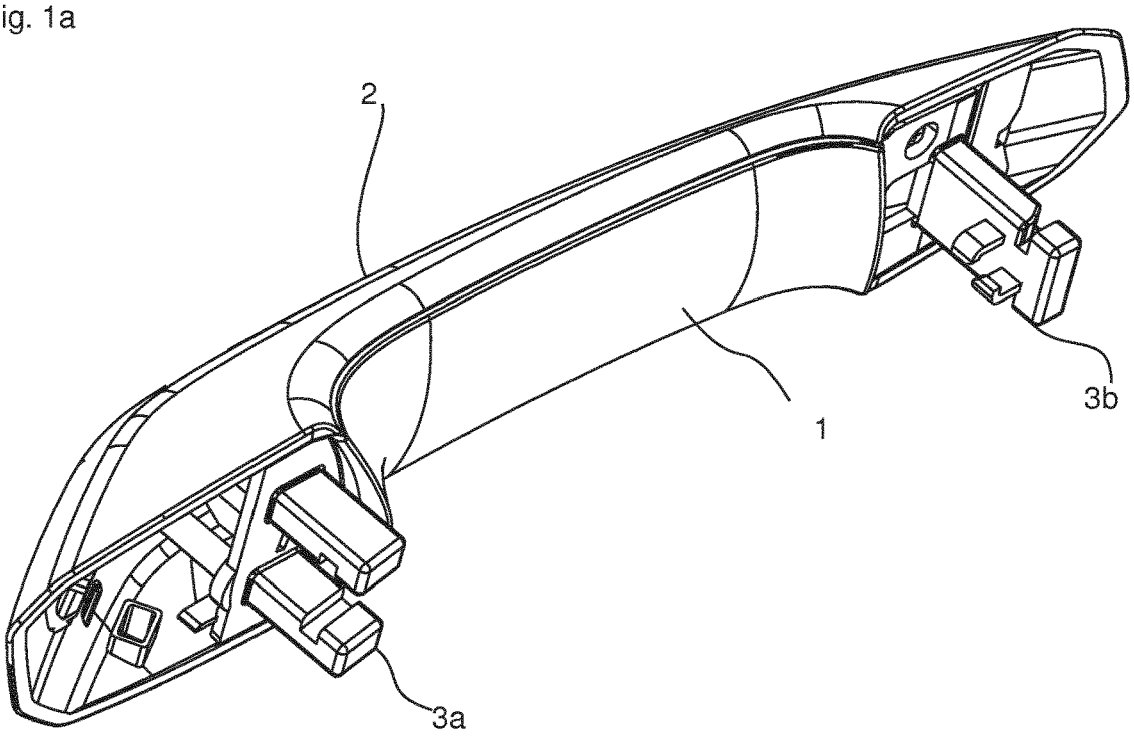

actuation region and has a deformability that is increased with respect to the remaining sections of the handle. The outer wall thickness is reduced solely on the outer wall face oriented towards the interior. The handle outer wall inner face oriented towards the interior is coated with a metal layer at least in the actuation region. The electronic sensor device comprises at least one inductive distance sensor which lies opposite the metal layer in the interior of the handle to detect a deformation of the opposing outer wall.

18 Claims, 4 Drawing Sheets

(30) Foreign Application Priority Data

Oct. 29, 2015 (DE) ..... 102015118525.3
Dec. 18, 2015 (EP) ..... 15201091

(56) References Cited

U.S. PATENT DOCUMENTS

2012/0133563 A1* 5/2012 Naka ..... E05B 81/77 343/713
2014/0367975 A1* 12/2014 Sanborn ..... H03K 17/962 292/336.3

FOREIGN PATENT DOCUMENTS

FR 2825743 A1 12/2002
WO WO-0140607 A1 6/2001
WO WO-2014188257 A1 11/2014

OTHER PUBLICATIONS

European Patent Office as the International Searching Authority, Written Opinion for PCT Application No. PCT/EP2016/065642, dated Sep. 22, 2016.

* cited by examiner

DOOR HANDLE ASSEMBLY FOR A MOTOR VEHICLE

CROSS-REFERENCE TO RELATED APPLICATIONS

This application claims priority under 35 U.S.C. § 371 to Patent Cooperation Treaty Application No. PCT/EP2016/065642, filed Jul. 4, 2016, which claims priority to DE Application No. 102015111311.2, filed Jul. 13, 2015, and to DE Application No. 102015118523.7, filed Oct. 29, 2015, and to DE Application No. 102015118525.3, filed Oct. 29, 2015, and to EP Application No. 15201091.4, filed Dec. 18, 2015, the entire contents of which are incorporated herein by reference.

The invention relates to a vehicle door handle assembly. In particular, the invention relates to an exterior door handle assembly with a sensor unit for detecting an actuation of the door handle. The vehicle door handle assembly has a handle that is provided for a user to actuate. It is possible to grasp behind at least one section of the handle in order to exert a pulling force on the doors.

The handle is embodied with an outer wall that delimits an interior of the handle. In the interior of the handle, sensor electronics are provided and are mounted in stationary fashion in the handle.

Vehicle door handles of the above-mentioned type are available in a wide variety of designs in motor vehicles. In such vehicle door handles, it is necessary to distinguish between handle systems with a movable handle and those with a stationary handle. In movable handles, a handle part of the handle assembly that is to be grasped under or grasped behind by the user is pivoted or moved in translatory fashion through the exertion of force. This movement is transmitted to a lock device inside the door to actuate the latter.

In stationary door handles, however, the handles are arranged so that they are largely stationary relative to the door. Such stationary vehicle door handles are usually used in combination with electrically triggered door locks, which are generally known by the term "e-latch."

An example of such a door system is disclosed in EP 0,584,499 A1. With stationary door handles, since there is no mechanical actuation path, no direct mechanical action chain is produced from the door handle to the door lock. Instead, the door lock is triggered electrically as a function of a detected actuation so that it is possible to reduce the amount of mechanical hardware and to achieve savings with regard to costs and weight.

The stationary door handle assemblies are distinguished by the way in which they detect an actuation. Switches or capacitive sensors can be used on or in the vehicle door handle. The object of the invention is to produce an improved actuation detection for vehicle door handle assemblies in stationary door handles of motor vehicles.

This object is attained by means of a door handle assembly with a sensor device according to the features of claim 1.

The vehicle door handle assembly according to the invention has a handle; the handle can be designed to be grasped around, from underneath, or from above. In any case, for actuation, it is necessary to grasp behind the handle in any section in order to be able to exert a pulling force that is necessary to open the door.

In this section that can be grasped behind, an actuating area is provided on the handle. The actuating area is defined in such a way that a reduced outer wall thickness of the handle is provided there. The outer wall is weakened in this area in order to provide an increased deformability there in comparison to the rest of the handle. According to the invention, the weakening of the outer wall strength is produced by reducing the wall thickness only on the side of the outer wall facing the interior. On the outside of the handle, i.e. in a surface region facing the vehicle door, the outer wall thickness is not reduced relative to the surrounding areas, i.e. the surface extends evenly there, without recesses. The weakening of the outer wall through reduction in the wall thickness is carried out from the inside of the housing wall, for example, through material removal in an area, a shaping of an area of the wall with a reduced cross-section, or a partial weakening for example by means of linear thinned areas provided in this area, or by means of intentionally provided milled regions or the like.

In this area with a reduced wall thickness, the inside of the outer wall of the handle is covered with a metallic layer. This layer can be an applied foil or can be a layer of metallic paint. It is also possible for thin metal sheets to be applied. It is basically also possible to introduce metal particles into the material in the thinned area.

The sensor electronics that are provided in stationary fashion on the inside of the handle have an inductive distance sensor. The inductive distance sensor is oriented toward the metallic layer so that the inductive distance sensor detects a deformation of the weakened area of the opposing outer wall that supports the metallic layer.

According to the invention, an area of a vehicle door handle assembly is mechanically weakened in order to subject this area to an increased deformation as compared to the other areas of the handle when the handle is actuated by a user. The mechanical stability of the entire handle system is thus essentially composed of the surrounding areas of the vehicle door handle. The intentionally weakened area is metallized on the inside of the handle facing the interior and a deformation of the area together with the metallization is detected by an inductive distance sensor.

By comparison with capacitive systems, this type of detection has an especially high sensitivity and reliability since the detection conditions inside the door handle are well defined and are subject to only slight changes.

Even very slight deformations are enough to be detected by the inductive distance sensor. Upon actuation, the metallic material of the weakened area of the handle moves relative to the inductive distance sensor since the distance sensor is in turn mounted in stationary fashion inside the handle. In other words, a relative movement occurs between the deformed outer wall and the distance sensor. The inductive distance sensors detect changes in the position and distance of metallic items in a very precise fashion. Inductive sensors are available on the market in a wide variety of designs. For example, they are used to monitor movements in production apparatuses, for detecting imbalances, or for detecting deflections of axles. For example, corresponding inductive sensor products are produced by the Texas Instruments Company (e.g., Texas Instruments LDC 1000-Q1).

According to the invention, the weakening of the handle in the actuating area is embodied so that the inherent elasticity of the wall material is sufficient to restore the wall to the original shape after an actuation. With the usual actuating forces, the deformation is therefore an elastic deformation at all times.

The signals of the sensor electronics with the inductive distance sensor can be evaluated in order to detect an actuation of the door handle. This actuation signal can be used to trigger an electric door lock so that the door is unlocked or is moved in the direction of an opening actuation.

In a preferred embodiment of the invention, the sensor electronics themselves are provided with an evaluation device, which detects and evaluates the signals of the inductive distance sensor. The sensor electronics then issue an actuation signal, which depends on the evaluation of the signals of the inductive distance sensor. The advantage of the evaluation electronics for the actuation being positioned in the door handle itself lies particularly in the simple set-up of the door handle, which issues definite actuation signals. In addition, the evaluation device can carry out continuous adjustments and calibrations, for example in order to take into account heat-induced expansions or length changes of the door handle.

In a preferred embodiment of the invention, the sensor electronics are embodied with a board that is accommodated in a holder, e.g. a kind of trough. The holder is mounted in the interior of the door handle and thus orients the inserted board with the sensor at a definite distance from the deformable outer wall.

It is particularly advantageous if the board is cast from a casting compound inside the holder. This fixes the position of the board in the holder and protects the board and the inductive sensor from environmental influences, especially from humidity or dirt.

The invention will now be explained in greater detail based on the accompanying drawings.

FIG. 1*a* shows a first exemplary embodiment of a door handle assembly according to the invention in a first perspective view.

Figure 1B:
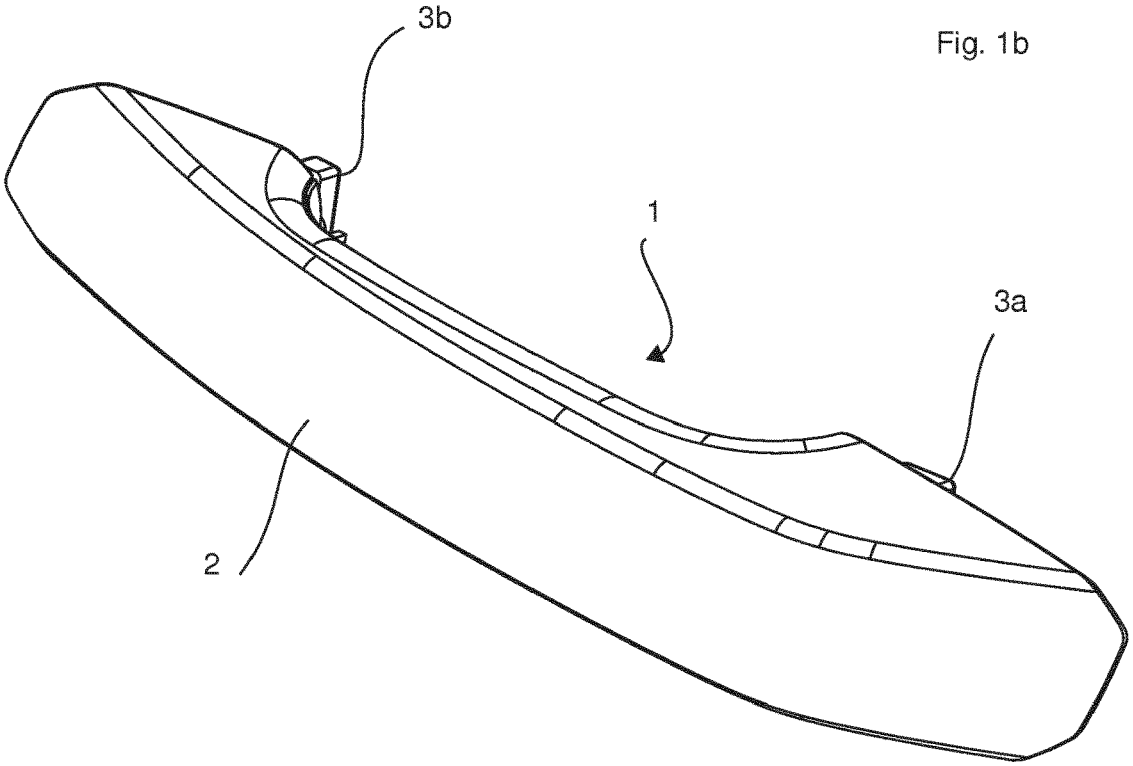

FIG. 1*b* shows the first exemplary embodiment of the invention in a second perspective view.

Figure 2:
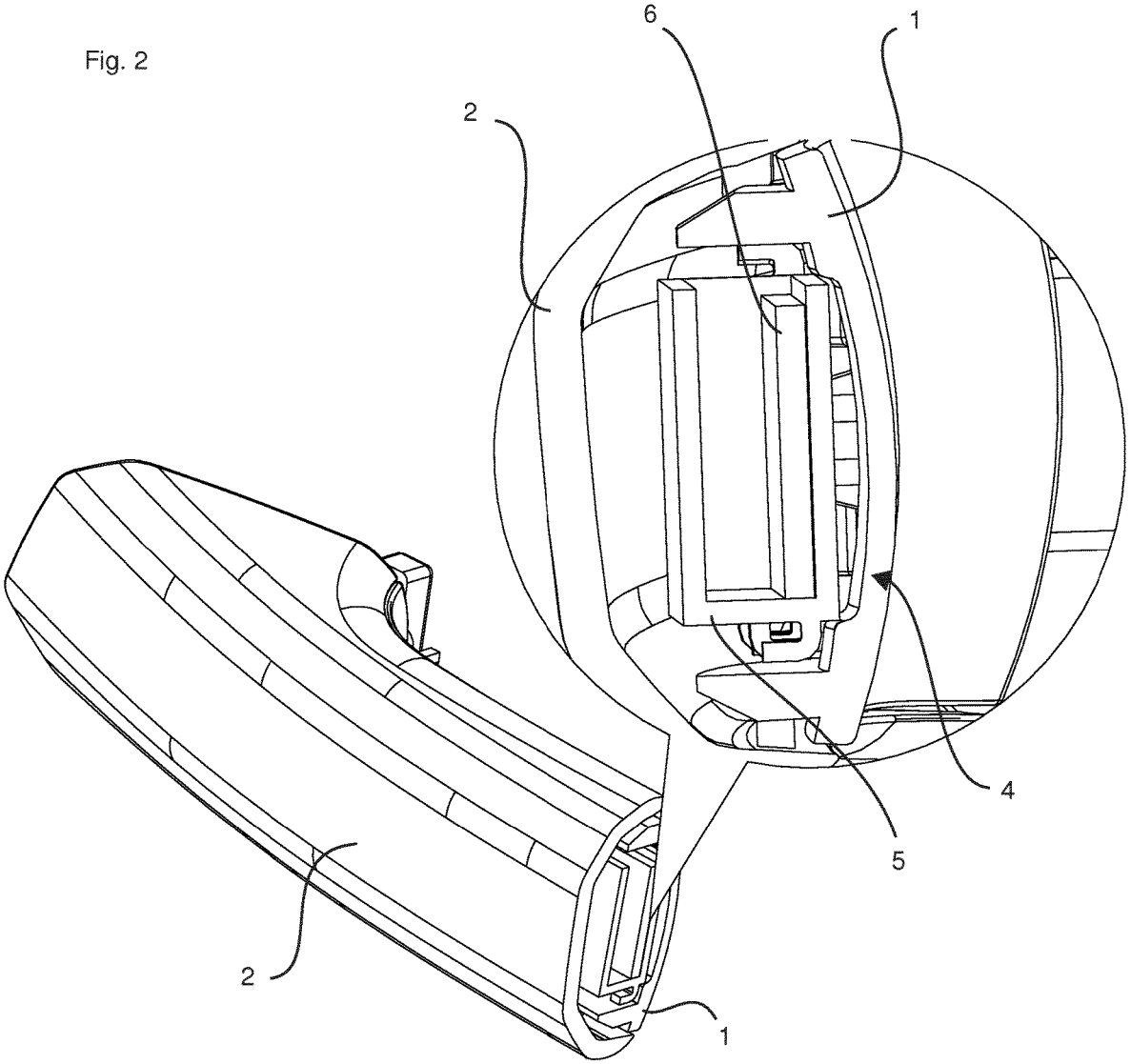

FIG. 2 shows a section through the door handle assembly according to the first exemplary embodiment with an associated enlarged detail.

Figure 3A:
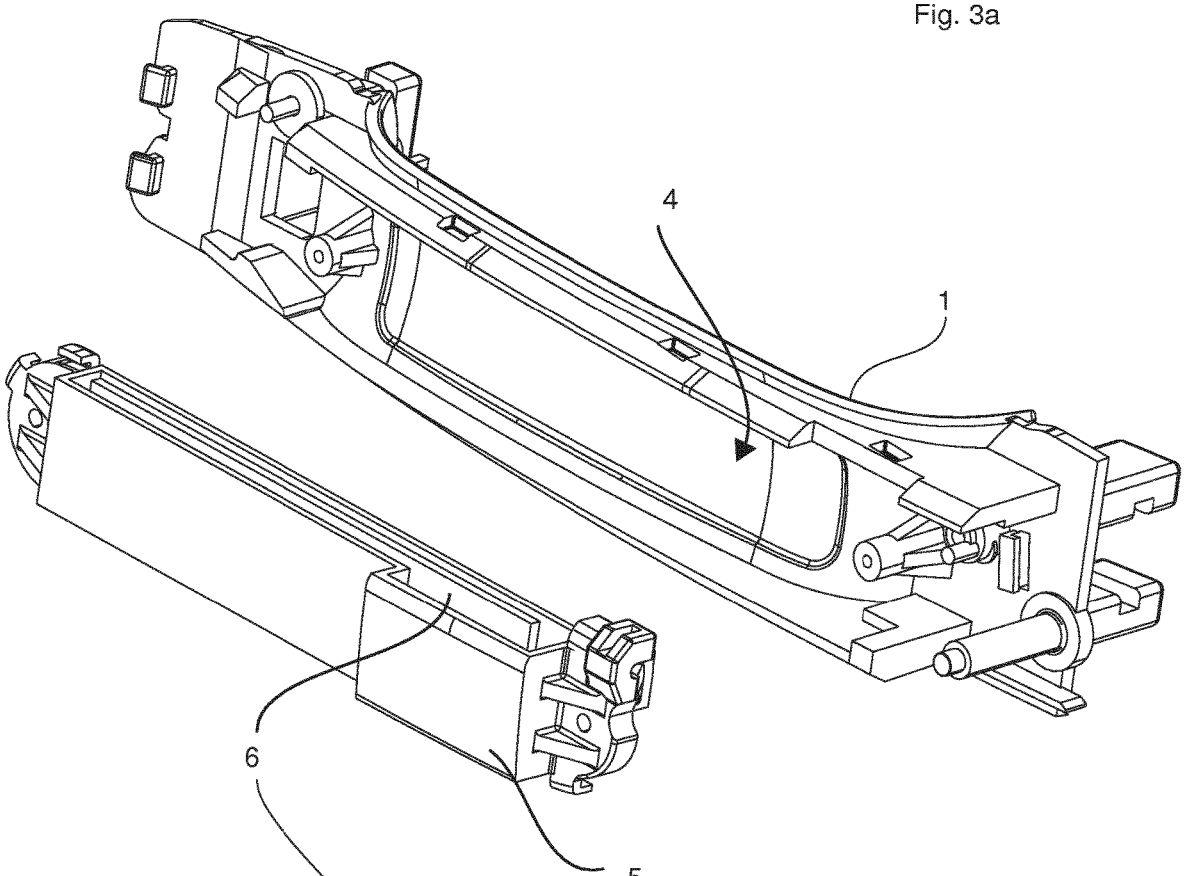

FIG. 3*a* shows the first exemplary embodiment with the cover inferred and partially disassembled.

Figure 3B:
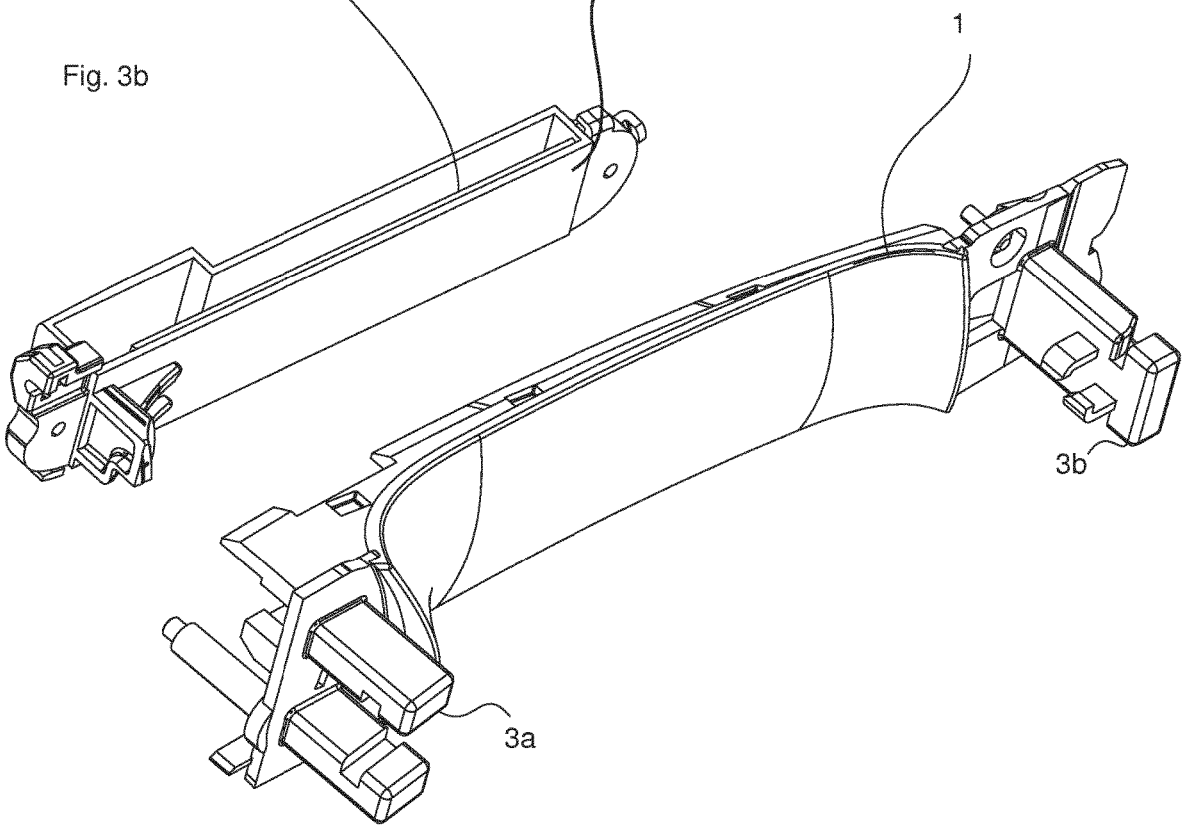

FIG. 3*b* shows the first exemplary embodiment from FIG. 3*a* from a different perspective.

Figure 4:
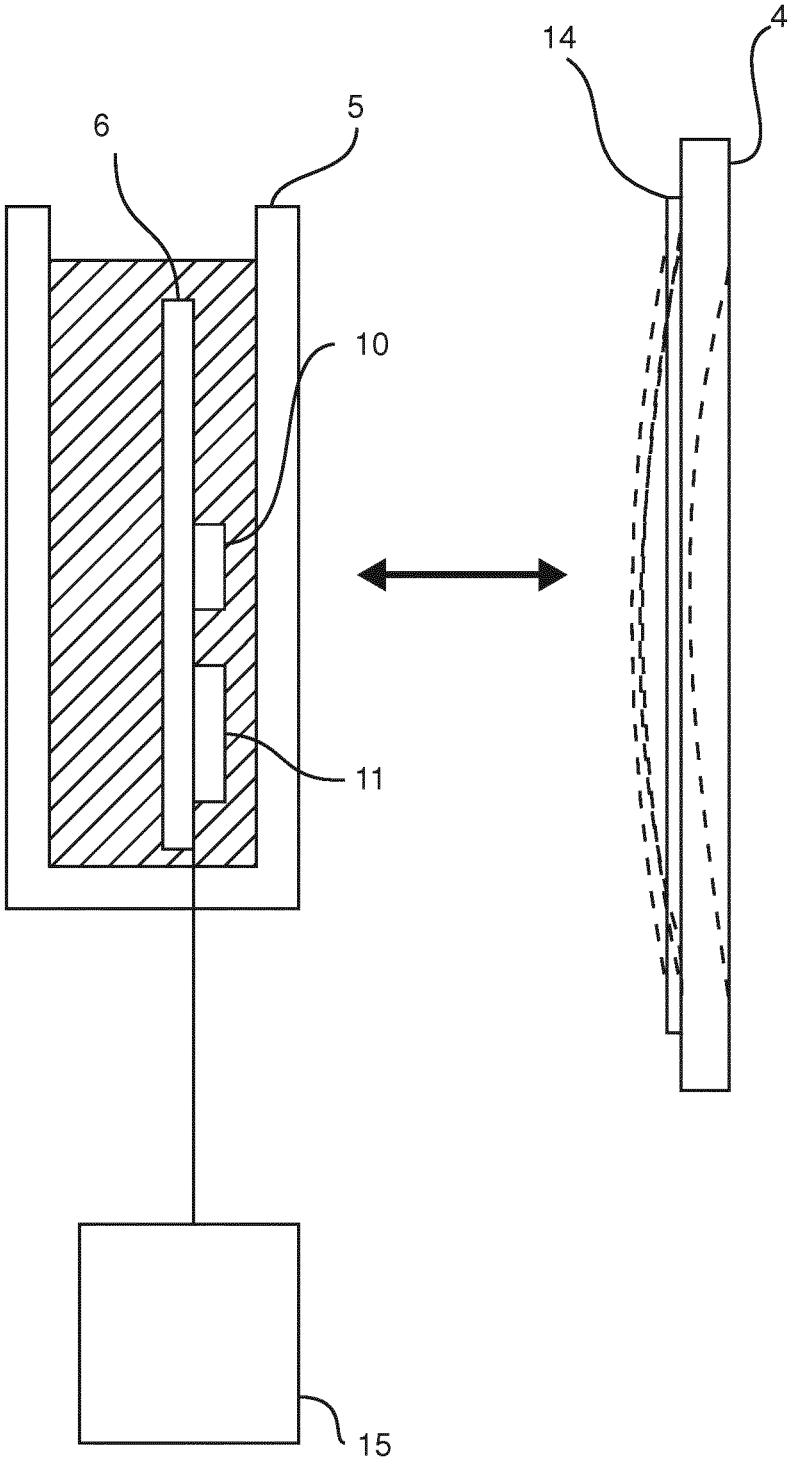

FIG. 4 shows a block circuit diagram of the components of the exemplary embodiment.

FIG. 1*a* shows a door handle assembly according to the invention according to a first exemplary embodiment. In this exemplary embodiment, a door handle is provided, with a handle composed of two shell parts, which in the assembled state form the handle of the door handle.

A handle inner part 1 of the handle facing the vehicle body is covered by a handle cover part 2, which faces away from the vehicle. Fastening means 3*a*, 3*b* are provided in order to permit the vehicle door handle assembly to be fastened to the vehicle. After the handle inner part 1 and handle cover part 2 have been assembled, they form the handle with an inner cavity in which electronic components of the handle can be accommodated. FIGS. 1*a* and 1*b* clearly show that in order to actuate a door, a user of the handle grasps behind the handle and in so doing, exerts a force on the handle inner part 1 if s/he wishes to open the door.

FIG. 2 shows a section approximately at the halfway point of the longitudinal span of the handle from FIGS. 1*a* and 1*b*. The sectional region is emphasized in an enlarged detail in order to afford a view of the interior. In this depiction, it is clear how the handle is formed by the handle inner part 1 and handle cover part 2, which cooperate to form the outer wall of the handle. It is also clear that the wall thickness of the handle inner part 1 is reduced in the sectionally depicted region in order to form an actuating area 4 with a reduced wall thickness. On the inside of the door handle, a holder 5 is mounted, which serves as a support for a set of sensor electronics 6. The sensor electronics 6 lie opposite from the thinned actuating area 4 and with inductive distance sensors, which are positioned on the sensor electronics 6, detect a deformation of the actuating area 4. This is possible because a metal foil is mounted on the actuating area 4; in this example, an adhesive aluminum foil is mounted on the corresponding inner region 4.

Whereas FIG. 2 shows the arrangement of components in the completely assembled handle, FIG. 3*a* shows the assembly with the handle cover part 2 removed. This depiction clearly shows how the area 4 of the handle inner part 1 is embodied as a weakened area with a thinner wall thickness. The area 4 is covered with an adhesive aluminum foil. The holder 5 in turn has fastening sections at its ends, which can be fixed in position by associated fastening means on the handle inner part 1. The sensor electronics 6 are inserted into the holder 5. For the sake of clarity, in this example, a situation is depicted in which the electronics are not cast in place; the electronics can, however, be cast in place in order to avoid external influences on the electronics.

FIG. 3*b* shows that the weakened area 4 is embodied with a reduced wall thickness only from the inside of the handle. The outside of the handle inner part 1 shown in FIG. 3*b* is embodied uniformly and with a smooth surface. This gives a user a more comfortable operating feel and prevents dirt, water, or ice from collecting or sticking in recessed areas and resulting in malfunctions. The weakening of the material is carried out only from the protected inside of the handle inner part 1.

The block circuit diagram in FIG. 4 shows the connection and interaction among the components. An inductive sensor 10 is coupled to an evaluation circuit 11 on a board 12. Spaced apart from this is a control region with a thinned wall cross-section, belonging to one shell 13 of a door handle. A metallic layer 14 is positioned on the side oriented toward the sensor 10. The metallic layer 14 can be deformed together with the underlying wall 13, as indicated by the dashed depiction and the double arrow. A deformation results in a change in the signals of the inductive distance sensor 10. The evaluation circuit 11 evaluates the signals of the sensor 10 and based on this, produces a control signal that is transmitted to a central control unit 15 in the vehicle. The evaluation circuit 11 permits a continuous calibration of the system; a sliding average is used as a starting value for detecting an actuation.

This makes it possible to adjust the sensitivity of the sensor 11 to changed environmental conditions such as temperature changes and expansions or contractions in length. If the inductive distance sensor 11 detects signals, which indicate that an actuation has occurred, then the evaluation circuit compares the corresponding sensor signals to the comparison values from the recent past.

There are various possible signal responses for a detection of the actuation. For example, it can be necessary for the actuation to exceed a certain threshold for a predetermined period of time in order to prompt a release of the door lock by issuing a corresponding actuation signal. It is basically also possible to detect other control patterns such as a multiple actuation.

The invention claimed is:

1. A vehicle door handle assembly comprising:

a handle including a graspable section that is configured to be grasped, an outer wall, an interior that is delimited by the outer wall, and sensor electronics arranged inside the handle and fixed in position therein;

wherein the handle includes a reduced outer wall thickness in an actuating area in the graspable section and the actuating area has an increased deformability in comparison to other sections of the handle, with the reduced outer wall thickness being embodied exclusively on a side of the outer wall facing the interior;

wherein the inside of the outer wall facing the interior is covered with a metallic layer at least in the actuating area;

wherein the sensor electronics have at least one inductive distance sensor arranged opposite from the metallic layer, the inductive distance sensor operable to detect a deformation of the outer wall that supports the metallic layer; and wherein the sensor electronics have an evaluation circuit that detects signals of the inductive distance sensor and as a function of these signals, determines whether an actuation has occurred and produces an output signal, the evaluation circuit permitting a continuous calibration using a sliding average as a starting value for detecting an actuation.

2. The vehicle door handle assembly according to claim 1, wherein the sensor electronics have a board on which the inductive distance sensor is embodied and the board is accommodated in a holder, the holder being mounted in stationary fashion in the interior of the handle.

3. The vehicle door handle assembly according to claim 2, wherein the board with the inductive distance sensor is cast into the holder with a casting compound.

4. The vehicle door handle assembly according to claim 1, wherein the actuating area, opposite the side of the outer wall facing the interior, includes a continuous exterior surface.

5. The vehicle door handle assembly according to claim 4, wherein the continuous exterior surface is one of convex or planar in the actuating area.

6. The vehicle door handle assembly according to claim 1, wherein the metallic layer includes one of a foil, a metallic paint, or a plurality of metal particles disposed within the actuating area.

7. The vehicle door handle assembly according to claim 1, wherein the actuating area includes an elastically-deformable material.

8. The vehicle door handle assembly according to claim 1, wherein the evaluation circuit is configured to:

detect a first signal of the inductive distance sensor;

detect a second signal of the inductive distance sensor;

compare the first signal to the second signal; and transmit a control signal to a central control unit based on the comparison of the first signal to the second signal.

9. The vehicle door handle assembly according to claim 1, wherein a position of the actuating area is configured to move relative to other sections of the handle, and wherein a position of the inductive distance sensor is fixed relative to the other sections of the handle.

10. A vehicle door handle assembly comprising:

an inner part configured to be pulled by a user, the inner part having an outer wall and an actuating area, the actuating area being moveable relative to the outer wall;

a metallic layer supported by the actuating area;

an inductive distance sensor fixed relative to the inner part and configured to detect a movement of the metallic layer; and wherein the inductive distance sensor is part of sensor electronics having an evaluation circuit that detects signals of the inductive distance sensor and as a function of these signals, determines whether an actuation has occurred and produces an output signal, the evaluation circuit permitting a continuous calibration using a sliding average as a starting value for detecting an actuation.

11. The vehicle door handle assembly according to claim 10, wherein the outer wall defines a first thickness in an area adjacent to the actuating area, and wherein the actuating area defines a second thickness less than the first thickness.

12. The vehicle door handle assembly according to claim 11, wherein the area adjacent to the actuating area surrounds the actuating area.

13. The vehicle door handle assembly according to claim 11, wherein the outer wall defines an inner surface and an outer surface, the inner surface facing the inductive distance sensor, the outer surface opposite the inner surface, and wherein the outer surface includes one of convex portion or a planar portion extending from the actuating area to the area adjacent to the actuating area.

14. The vehicle door handle assembly according to claim 10, wherein the actuating area includes an elastically-deformable material.

15. The vehicle door handle assembly according to claim 10, wherein the metallic layer includes one of a foil, a metallic paint, or a plurality of metal particles disposed within the actuating area.

16. The vehicle door handle assembly according to claim 10, wherein the evaluation circuit is configured to:

detect a first signal of the inductive distance sensor;

detect a second signal of the inductive distance sensor;

compare the first signal to the second signal; and transmit a control signal to a central control unit based on the comparison of the first signal to the second signal.

17. The vehicle door handle assembly according to claim 10, further comprising a board supporting the inductive distance sensor, the board supported by a holder fixed within an interior of the handle assembly.

18. The vehicle door handle assembly according to claim 17, further comprising a casting compound, wherein the board is secured to the holder with the casting compound.

* * * * *